US012486011B2

(12) United States Patent
Savage et al.

(10) Patent No.: US 12,486,011 B2
(45) Date of Patent: Dec. 2, 2025

(54) MARINE MOTOR ASSEMBLY AND COVER FOR A MARINE MOTOR ASSEMBLY

(71) Applicant: BRP US Inc., Sturtevant, WI (US)

(72) Inventors: Dillon Savage, Waterford, WI (US); Dale A. Wiegele, Kenosha, WI (US); Samuel Mcginley, Milwaukee, WI (US); Matthew Coyne, Milwaukee, WI (US)

(73) Assignee: BRP US Inc.

( * ) Notice: Subject to any disclaimer, the term of this patent is extended or adjusted under 35 U.S.C. 154(b) by 137 days.

(21) Appl. No.: 18/365,327

(22) Filed: Aug. 4, 2023

(65) Prior Publication Data

US 2025/0042522 A1 Feb. 6, 2025

Related U.S. Application Data

(60) Provisional application No. 63/516,614, filed on Jul. 31, 2023.

(51) Int. Cl.
*B63H 20/02* (2006.01)
*B63H 20/32* (2006.01)

(52) U.S. Cl.
CPC ..... *B63H 20/02* (2013.01); *B63H 20/32* (2013.01); *B63H 2020/025* (2013.01)

(58) Field of Classification Search
CPC ... B63H 20/02; B63H 20/32; B63H 2020/025
USPC ..... 248/640
See application file for complete search history.

(56) References Cited

U.S. PATENT DOCUMENTS 3,336,092 A * 8/1967 Dochterman ..... F16C 33/20 384/413
4,723,926 A * 2/1988 Uehara ..... B63H 21/305 440/52
5,055,074 A * 10/1991 Westberg ..... B63H 20/32 123/195 P
5,096,208 A * 3/1992 Westberg ..... F16J 15/027 123/195 P
5,215,485 A * 6/1993 Bonner ..... B63H 20/32 D12/317
5,344,350 A * 9/1994 Hatch ..... B63H 20/32 123/195 P (Continued)

OTHER PUBLICATIONS

"Overview of materials for Acrylonitrile/Styrene/Acrylate (ASA), Unreinforced, Molded", spec sheet retrieved from https://www.matweb.com/search/datasheet.aspx?matguid=24c5655bc30e42c3949df6c53122bd61&ckck=1, on Aug. 4, 2023.

*Primary Examiner* — Muhammad Ijaz
(74) *Attorney, Agent, or Firm* — BCF LLP

(57) ABSTRACT

A marine motor assembly for a watercraft and a cover for a marine motor assembly. The assembly includes a housing; a motor disposed in the housing; and a propulsion device operatively connected to the motor. The housing includes a housing portion, and a cover selectively connected to the housing portion. The cover includes a cover body connectable to the housing portion, the cover body covering at least a portion of the motor; a noise dampening material layer disposed on an exterior side of the cover body; and a surface structure connected to the cover body, the noise dampening material layer being enclosed between the cover body and the surface structure.

20 Claims, 10 Drawing Sheets

(56) References Cited

U.S. PATENT DOCUMENTS 5,360,358 A * 11/1994 Haman ..... B63H 20/32 123/195 P
6,875,066 B2 * 4/2005 Wolaver ..... F02B 77/13 181/204
7,485,019 B1 * 2/2009 Macier ..... F02B 77/13 181/204
9,073,616 B1 * 7/2015 Wiegele ..... B63H 20/32
9,180,950 B1 * 11/2015 Davenport ..... B63H 20/32
9,475,560 B1 * 10/2016 Jaszewski ..... B63H 20/32
9,481,438 B1 * 11/2016 Tuchscherer ..... B63H 20/32
10,710,692 B1 * 7/2020 Wittich ..... B63H 20/36
10,933,957 B2 3/2021 Doyon et al.
11,046,409 B2 * 6/2021 Wiegele ..... B63H 20/28
11,214,259 B2 1/2022 Nolin et al.
11,305,857 B1 * 4/2022 Jaeger ..... F02B 61/045
11,312,462 B1 * 4/2022 Faust ..... E05B 73/0076
11,486,340 B1 * 11/2022 Gunderson ..... B63H 20/001
11,492,088 B1 * 11/2022 Broughton ..... B63B 59/02
11,577,809 B1 * 2/2023 Faust ..... B63H 20/32
11,760,458 B2 * 9/2023 Hasegawa ..... F02M 35/167 123/184.21
12,208,874 B1 * 1/2025 Davenport ..... F16H 57/0037
2006/0137646 A1 * 6/2006 Nakamura ..... B22D 17/22 164/271
2007/0243776 A1 * 10/2007 Hasegawa ..... B63H 20/32 440/77
2007/0254539 A1 * 11/2007 Yazaki ..... F02B 61/045 440/77
2018/0244195 A1 * 8/2018 Haight ..... G01S 13/867
2020/0198748 A1 * 6/2020 Wiegele ..... F01P 7/16
2021/0001967 A1 * 1/2021 Ahlgren ..... B63H 20/10
2024/0158060 A1 * 5/2024 Przybyl ..... B63H 20/32
2024/0359784 A1 * 10/2024 Savage ..... B63H 20/245
2024/0391577 A1 * 11/2024 Davenport ..... B63H 21/386
2025/0042522 A1 * 2/2025 Savage ..... B63H 20/32

* cited by examiner

MARINE MOTOR ASSEMBLY AND COVER FOR A MARINE MOTOR ASSEMBLY

CROSS-REFERENCE

The present application claims priority to U.S. Provisional Application No. 63/516,614, entitled "Marine Motor Assembly and Cover for a Marine Motor Assembly," filed Jul. 31, 2023, the entirety of which is incorporated by reference.

TECHNICAL FIELD

The present technology relates to marine engine assemblies.

BACKGROUND

A typical marine motor assembly, also referred to as an outboard engine, has a motor disposed inside a housing and a gearcase supporting a propeller. The housing typically includes a removable cover made of fiberglass or the like. This material provides an esthetically pleasing outer surface and is easily formable. To improve sound dampening properties, noise insulating foam is generally added along the inner surface of the cover.

There remains a desire for different structural arrangements for marine motor assemblies.

SUMMARY

It is an object of the present technology to ameliorate at least some of the inconveniences present in the prior art.

According to embodiments of the present technology, there is provided a cover for a marine motor assembly providing both good noise and vibration insulation and esthetically pleasing outer surfaces.

A main cover body is formed from direct long fiber thermoplastic (DLFT) which is fastened to an upper housing portion and surrounds the engine or motor disposed in the housing. According to some embodiments, Polytec™ material can be used, which is a glass fiber-reinforced polypropylene (thermoplastic) resin. This material is strong, light and has better sound and vibration dampening characteristics than conventional (thermoset) fiberglass. It does not, however, generally provide an esthetically pleasing surface finish.

An outer surface structure made of acrylonitrile styrene acrylate (ASA) is mounted outside the cover body and provides a cosmetic surface to the exterior of the cover. ASA is another thermoplastic with good moldability, resistance to scratching, is easy to adhere decals to and is cost effective. It does not generally provide much structural rigidity. A thin layer of conventional fiberglass could also be used in some embodiments.

Sandwiched between the cover body and the surface structure is a layer of noise vibration harshness (NVH) foam, also known as acoustic foam, i.e. a foam material that dampens noise, vibration and harshness. Other materials could be used, such as rubbers or fibrous mats (felt) for similar purposes. This sandwiching, in addition to the use of DLFT instead of fiberglass, also aids in increasing sound dampening. The sandwiched foam layer also aids in preventing the relatively rigid DLFT and ASA layers from rubbing or rattling. In addition to the sandwiched first layer of foam, an inner layer of NVH foam is disposed along the inside of the cover body.

In accordance with a first broad aspect of the present disclosure, there is provided a marine motor assembly for a watercraft, the marine motor assembly including a housing; a motor disposed in the housing; and a propulsion device operatively connected to the motor, the housing including a housing portion, and a cover selectively connected to the housing portion, the cover including a cover body connectable to the housing portion, the cover body covering at least a portion of the motor; a noise dampening material layer disposed on an exterior side of the cover body; and a surface structure connected to the cover body, the noise dampening material layer being enclosed between the cover body and the surface structure.

In some embodiments, the cover body is formed from a first material; the surface structure is formed from a second material; and the first material and the second material are different materials. In some embodiments, the first material is has greater rigidity than the second material. In some embodiments, the cover body provides structural integrity of the cover. In some embodiments, the second material has a glossier surface finish.

In some embodiments, the cover body is sealingly connectable to the housing portion.

In some embodiments, the cover further comprises an inner noise dampening material layer disposed on an interior side of the cover body. In some embodiments, the inner noise dampening material layer is formed from noise vibration harshness (NVH) foam. In some embodiments, the inner noise dampening material layer is connected to the cover body by clips.

In some embodiments, the surface structure includes a plurality of surface panels. In some embodiments, the plurality of surface panels includes at least one top side panel connected to a top side of the cover body and at least one side panel connected to a lateral side of the cover body.

In some embodiments, the noise dampening material layer is formed from a plurality of separated layer portions.

In some embodiments, the noise dampening material layer is formed from noise vibration harshness (NVH) foam.

In some embodiments, the cover further includes a plurality of bumpers extending along one of a top surface of the cover and a rear surface of the cover. In some embodiments, each bumper of the plurality of bumpers is fastened to the cover body by a plurality of fasteners, the plurality of fasteners extending through the surface structure.

In some embodiments, the cover body is formed from direct long fiber thermoplastic (DLFT); and the surface structure is formed from acrylonitrile styrene acrylate (ASA).

In some embodiments, the DLFT forming the cover body is a glass fiber-reinforced polypropylene (thermoplastic) resin.

In accordance with another broad aspect of the present disclosure, there is provided a cover for a marine motor assembly, the cover being connectable to a housing portion for forming a housing of the marine motor assembly, the cover including a cover body connectable to the housing portion, when the cover body is connected to the housing portion, the cover body covering at least a majority of powerpack components of the marine motor assembly; a noise dampening material layer disposed on an exterior side of the cover body; and a surface structure connected to the cover body, the noise dampening material layer being enclosed between the cover body and the surface structure.

For purposes of this application, terms related to spatial orientation such as forward, rearward, upward, downward, left, and right, should be understood in a frame of reference of the marine motor assembly, as it would be mounted to a watercraft in a neutral trim position. Terms related to spatial orientation when describing or referring to components or sub-assemblies of the engine assembly separately therefrom should be understood as they would be understood when these components or sub-assemblies are mounted in the marine motor assembly, unless specified otherwise in this application.

Explanations and/or definitions of terms provided in the present application take precedence over explanations and/or definitions of these or similar terms that may be found in any documents incorporated herein by reference.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of embodiment of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

It should be noted that the Figures are not necessarily drawn to scale.

DETAILED DESCRIPTION

The present technology is described with reference to a marine motor assembly 100 that is used to propel a watercraft and is configured to be disposed under the deck of the watercraft it propels. It is contemplated that the marine motor assembly 100 may be disposed at a transom of a watercraft, but not beneath its deck and that aspects of the present technology could be used in other types of marine engine assemblies, such as in a marine outboard motors having a midsection connected below the engine, a gearcase connected below the midsection, and a transom bracket configured to connect the midsection to a watercraft.

Figure 1:
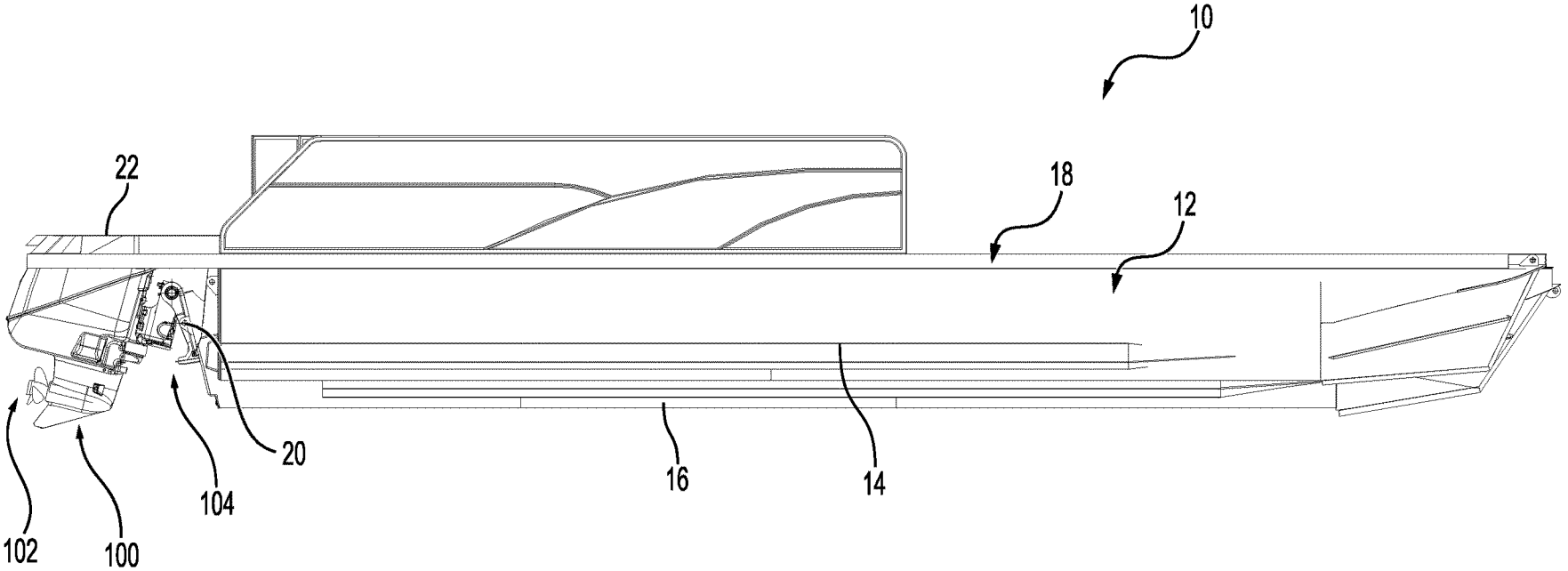
FIG. 1 is a right side elevation view of a watercraft having a marine motor assembly according to an embodiment of the present technology.

In FIG. 1, a watercraft 10 is illustrated. The watercraft 10 illustrated is a pontoon boat 10, but this is one non-limiting example of a watercraft according to the present technology and other types of watercraft are contemplated. This particular embodiment of the boat 10 includes a watercraft body 12 formed generally from two side pontoons 14 (only one being illustrated), a central pontoon 16 and a platform 18.

The boat 10 also includes the marine motor assembly 100, also referred to herein as the assembly 100. The assembly 100 is pivotably and rotatably connected to the watercraft body 12 for providing propulsion via a propulsion device 102. The propulsion device 102 is a propeller 102 in the present embodiment, but it is contemplated that the propulsion device 102 could be different in alternative embodiments. For example, it is contemplated that the propulsion device 102 could be an impeller of a marine jet propulsion device or another type of propeller, such as a ducted propeller.

The assembly 100 includes a transom bracket 104 which is fastened to the watercraft body 12. The transom bracket 104 is connected to a transom 20 of the central pontoon 16, such that the assembly 100 is generally disposed below a top surface 22, also called the deck 22, of the platform 18 laterally between the pontoons 14.

Figure 2:
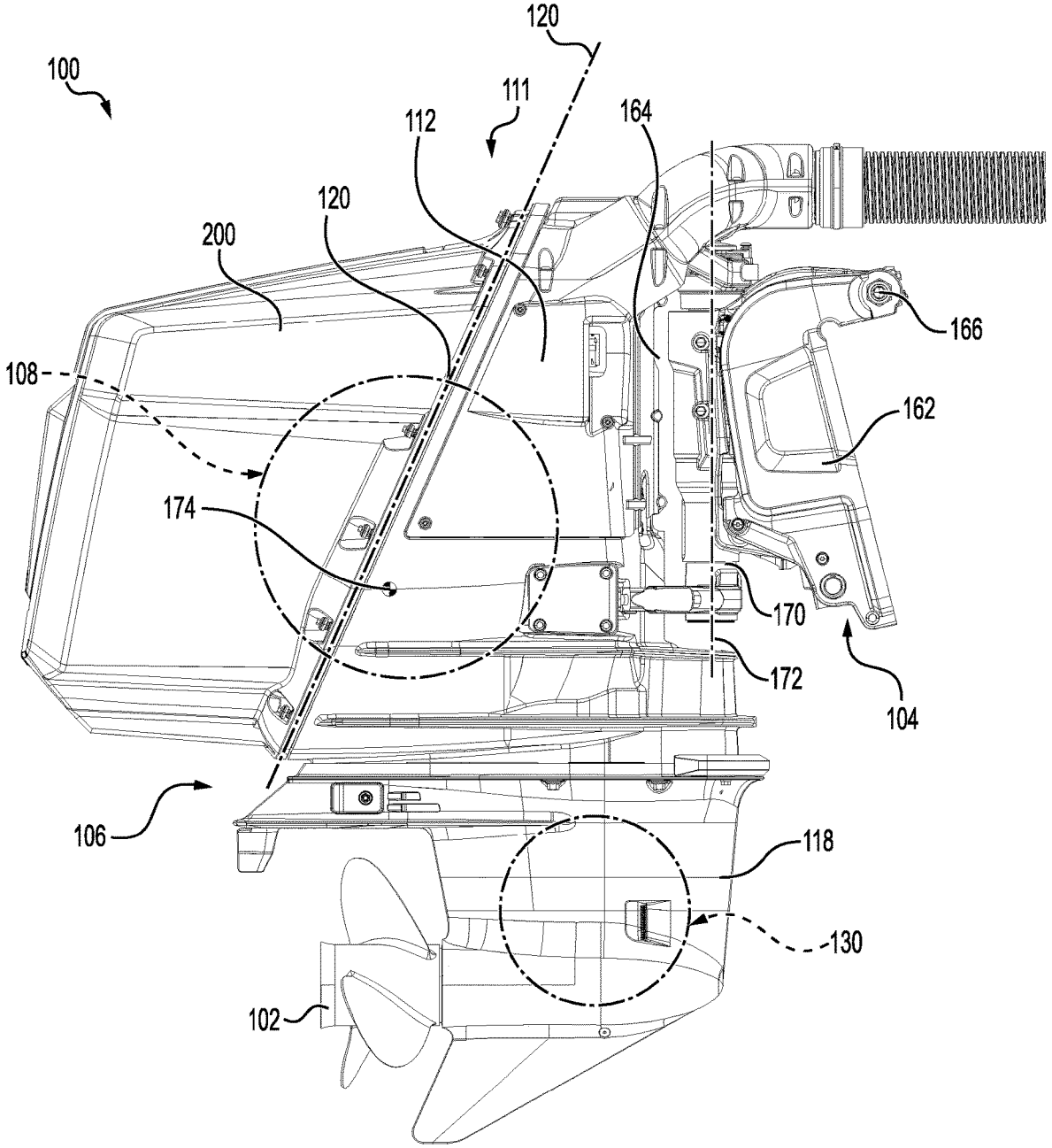
FIG. 2 is a right side elevation view of the marine motor assembly of the watercraft of FIG. 1.
Figure 3:
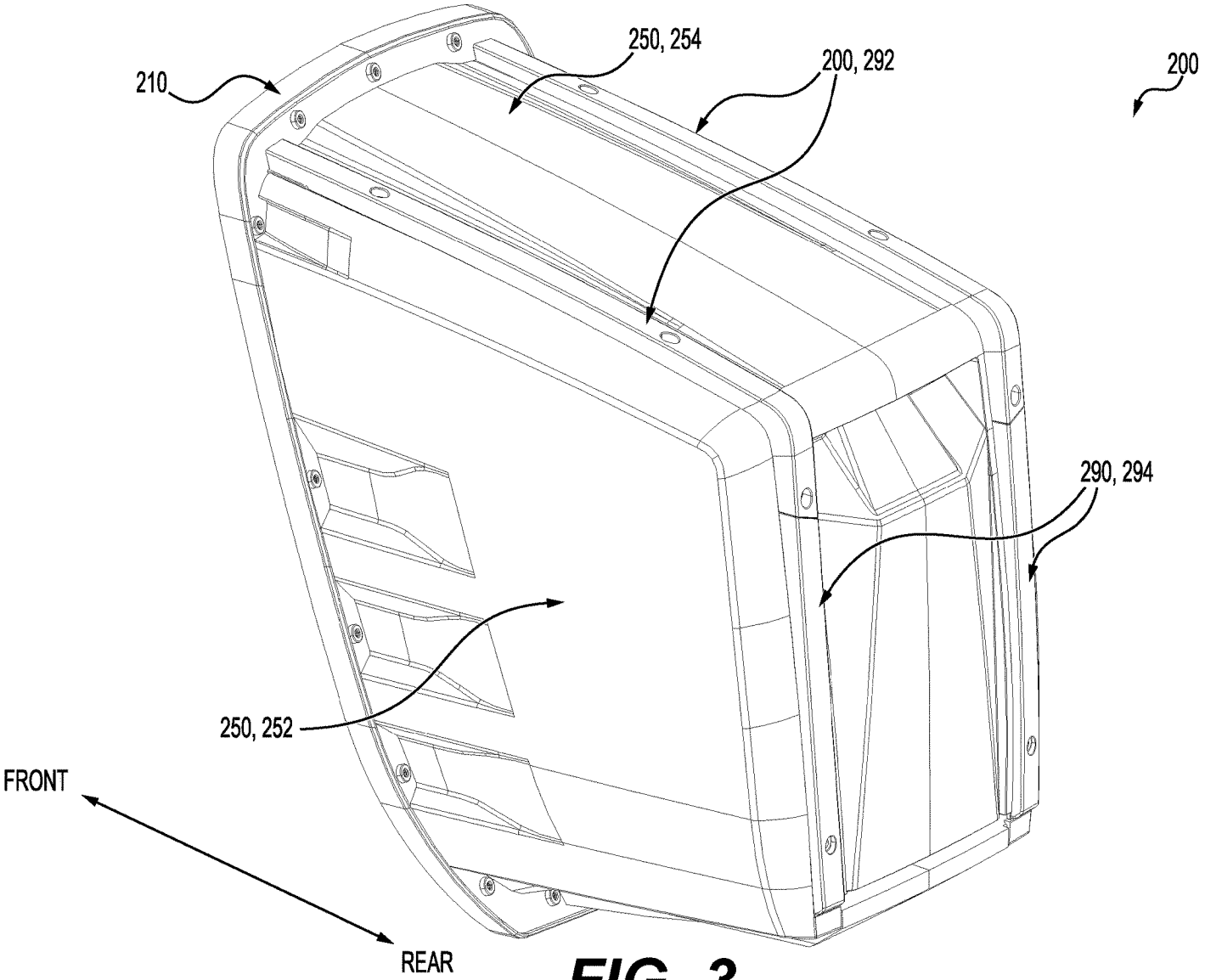
FIG. 3 is a top, rear, left side perspective view of a cover of the marine motor assembly of FIG. 2.
Figure 4:
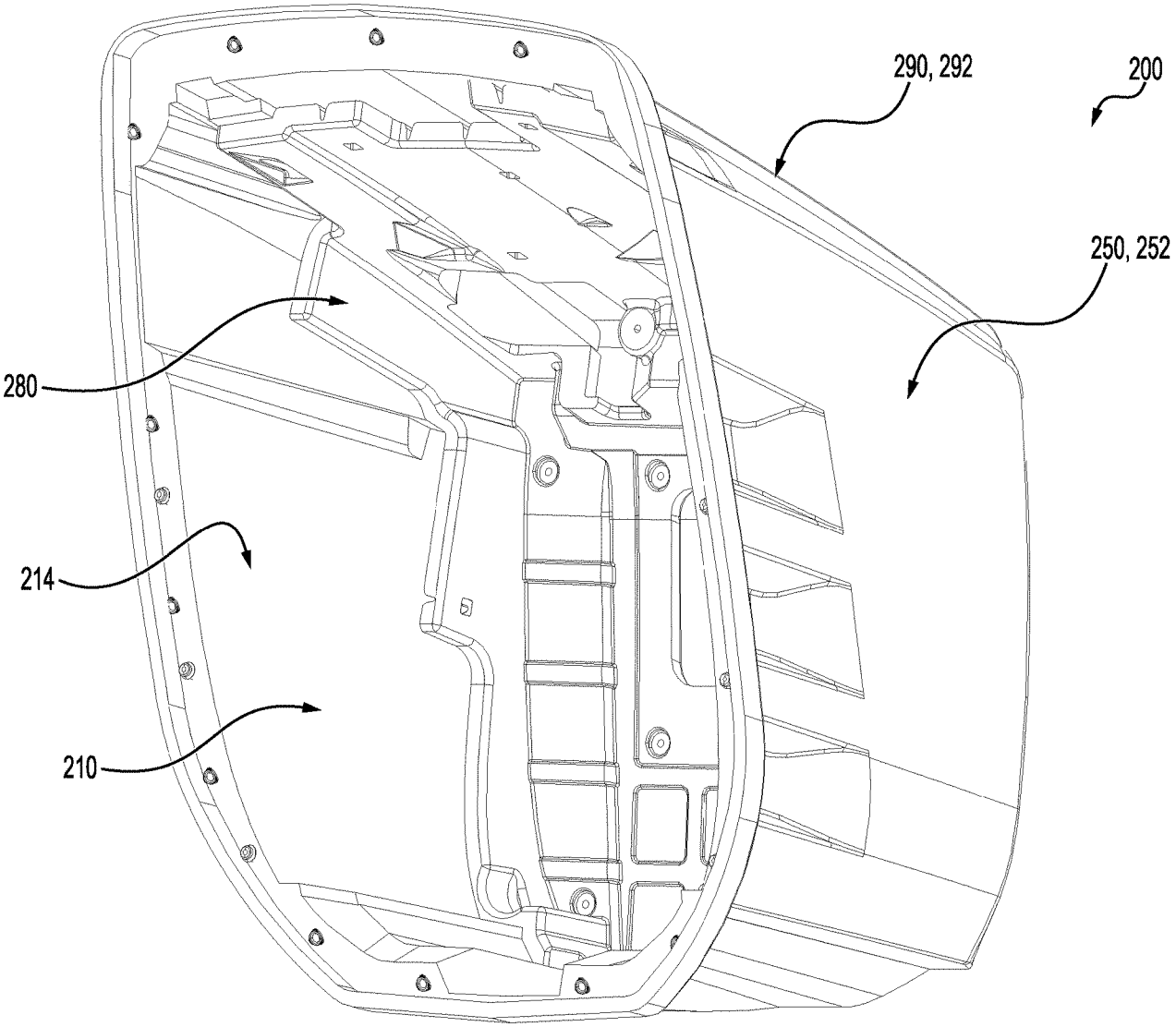
FIG. 4 is a front, left side perspective view of the cover of FIG. 3.

With reference to FIG. 2, the marine motor assembly 100 is illustrated separately from the watercraft 10. The marine motor assembly 100, also referred to herein as the assembly 100, is commonly referred to as an outboard engine although it is noted that the assembly 100 could be powered by an electric motor rather than an engine. The assembly 100 includes the propeller 102, the transom bracket 104, a housing 106, a motor 108 (shown schematically), a series of gearsets and a transmission assembly 130 (shown schematically) that operatively connects the motor 108 to the propeller 102, as well as other components disposed in the housing 106. It is to be noted that in the illustrated embodiment, the motor 108 is an internal combustion engine 108. In other embodiments, however, the motor 108 could be an electric motor.

The housing 106 supports and covers components disposed therein. The housing 106 includes an upper housing portion 111, which includes an outer housing 112, an inner housing (not shown), and a cover 200. The housing 106 also includes a gearcase 118 that is connected to the upper housing portion 111. Connection of the cover 200 to the upper housing portion 111 will be described in more detail below. The cover 200 and the outer housing 112 define a volume therebetween. The inner housing is disposed in the outer housing 112 and is therefore housed in the volume defined between the cover 200 and the outer housing 112. The cover 200 is removably connected to the outer housing 112 along a diagonally extending parting line 120. In the present embodiment, the cover 200 is connected to the outer housing 112 using fasteners, but other types of connections, such as clamps or latches are contemplated. A seal (not shown) is provided between the cover 200 and the outer housing 112 along the parting line 120 to sealingly connect the cover 200 to the upper housing portion 111.

The motor 108 is connected to a back of the inner housing and is supported in the housing 106 by the inner housing. As such, the motor 108 is housed in the volume defined between the cover 200 and the outer housing 112. By removing the cover 200, the motor 108 can be accessed.

The gearcase 118 is connected to a bottom of the outer housing 112. The gearcase 118 at least in part houses a transmission (not shown) connecting the motor 108 to the propeller 102, the propeller 102 being operatively connected to gearcase 118.

In the present embodiment, the outer housing 112 and the inner housing are cast metal parts, but other materials and manufacturing methods are contemplated. It is also contemplated that the outer housing 112 and the inner housing could be made as a single integral component, or could be made as more than two components that are then connected together. The gearcase 118 is made from cast aluminum, but other materials are contemplated. The cover 200 will be described in more detail below.

With continued reference to FIG. 2, the transom bracket 104 includes a watercraft portion 162 which is adapted for fastening to the watercraft body 12. The transom bracket 104 also includes an engine portion 164, pivotally connected to the watercraft portion 162, and which is fastened to the front of the outer housing 112. The engine portion 164 is pivotable with respect to the watercraft portion 162 about a tilt-trim axis 166. The transom bracket 104 thus defines the tilt-trim axis 166 of the assembly 100, about which the assembly 100 can be trimmed or tilted relative to the watercraft body 12. The engine portion 164 includes a steering actuator 170 configured for steering the housing 106, and therefore the propeller 102, relative to the transom bracket 104 about a steering axis 172. In the present embodiment, the steering actuator 170 is a rotary hydraulic actuator, but other types of steering actuators 170 are contemplated.

In the present embodiment, a center of gravity 174 of the engine 108 is disposed below the tilt-trim axis 166, when the assembly 100 is in a trim range. As the assembly 100 is designed to be disposed below the deck 18, the engine 108 and the transom bracket 104 partially vertically overlap, rather than the engine 108 being disposed well above the bracket 104 as would be the case in a conventional outboard engine assembly meant to extend higher relative to the watercraft body 12. In the present embodiment, the center of gravity 174 is vertically between a top end of the transom bracket 104 and a bottom end of the transom bracket 104.

With reference to the FIGS. 3 to 10, the cover 200 will now be described in more detail. As is noted above, the cover 200 is selectively connected to the outer housing 112 to form the upper housing portion 111 and more generally the housing 106 of the assembly 100.

According to the present technology, the cover 200 is formed from a plurality of different material layers to provide desired structural strength, noise-dampening, and esthetic characteristics. The cover 200 includes a cover body 210 forming the main form of the cover 200. The cover body 210 is connectable, selectively fastenable, to the outer housing 112. When the cover 200 is connected to the outer housing 112, the cover body 210 covers much of the components disposed inside the housing 106, including a majority of powerpack components of the marine motor assembly 100.

The cover body 210 provides the structural integrity of the cover 200, through both the shape of the cover body 210 and the material selection. Specifically, the cover body 210 is formed from a direct long fiber thermoplastic (DLFT). In the present embodiment, the DLFT is specifically a glass fiber-reinforced polypropylene (thermoplastic) resin. In some embodiments, the composite known under the commercial name Polytec™ could be used; see for instance U.S. Pat. No. 10,933,957, issued Mar. 2, 2021, the entirety of which is incorporated by reference. DLFT material is generally strong (generally considered rigid with compression and tensile strength), lightweight, and provides sound and vibration dampening. Such material does generally not provide an esthetically pleasing surface, however, as DLFT material tends to have a rough, non-glossy finish when formed. According to the present technology, the cover 200 thus includes a plurality of surface panels 250 (detailed below) to cover the non-esthetic surfaces of the cover body 210, in order to both take advantage of the strength and sound dampening properties of the DLFT and have an esthetically pleasing exterior.

Figure 5:
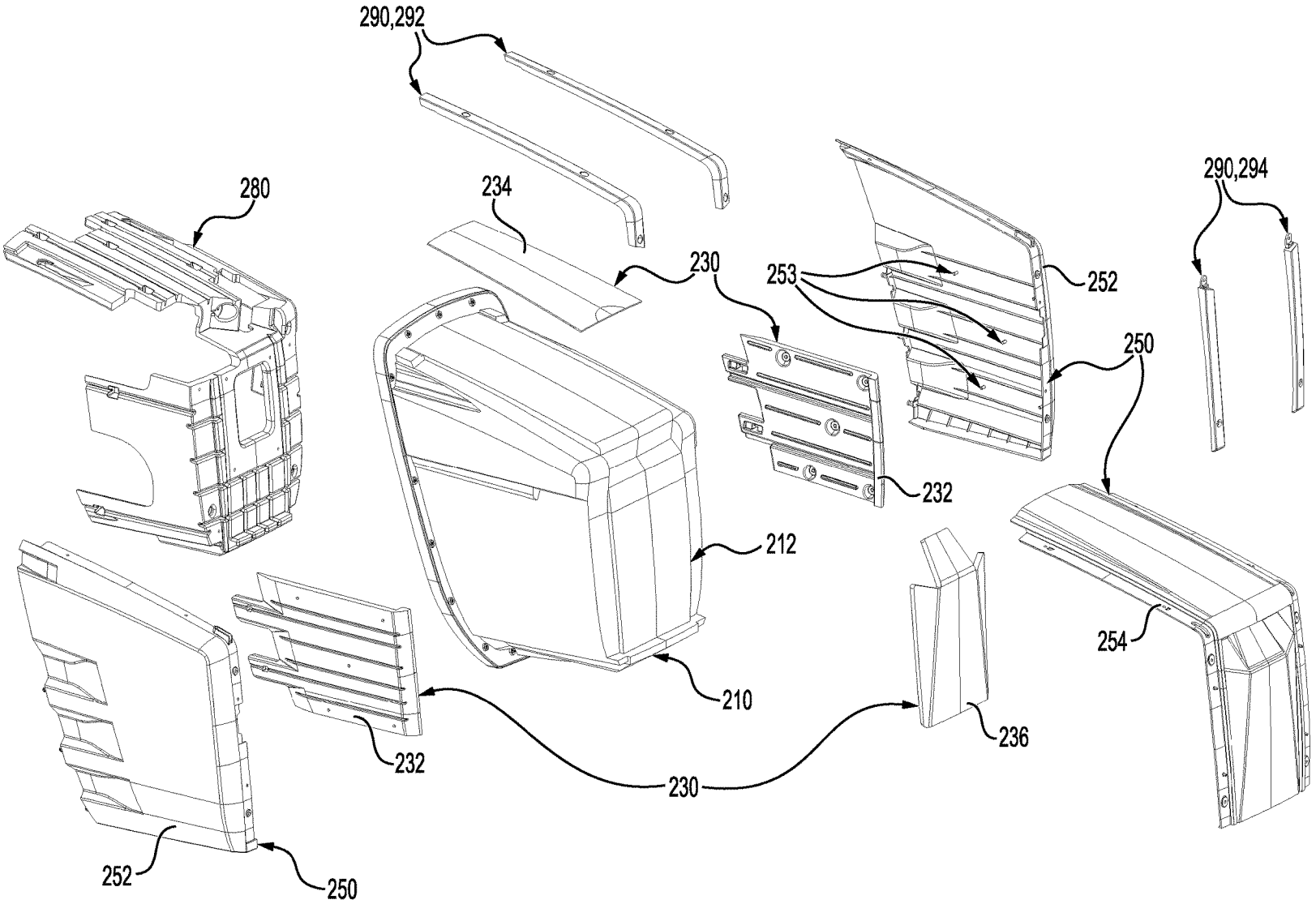
FIG. 5 is an exploded, perspective view taken from the rear, left side of the cover of FIG. 3.
Figure 6:
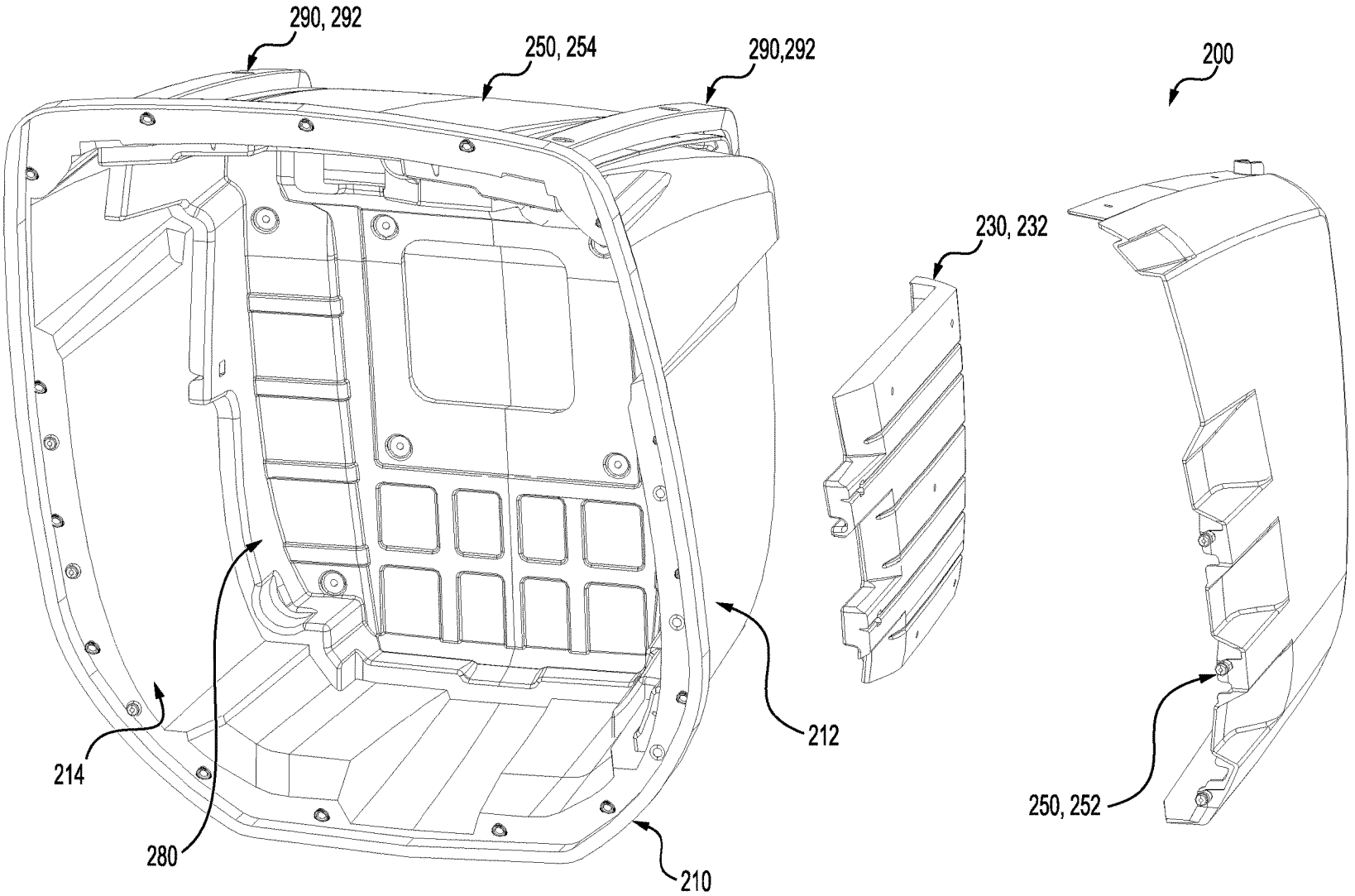
FIG. 6 is a partially exploded, perspective view taken from the front, left side of the cover of FIG. 3.

The cover 200 further includes a surface structure 250 providing esthetic exterior surfaces for the cover 200. The surface structure 250 is connected to the cover body 210; the mode of connection will be described in more detail below. In the illustrated embodiment, the surface structure 250 includes a plurality of surface panels 250 which cover an exterior of the cover body 210, providing an outer esthetic surface for the cover 200. As can be seen in FIG. 5, the surface panels 250 include left and right side panels 252 for covering lateral sides of the cover body 210. The surface panels 250 further include a top and rear panel 254 covering top and rear sides of the cover body 210. The panel 254 extends along a top of the cover body 210 rearward and then downward to cover a rear side of the cover body 210. It is contemplated that some or all of the surface panels 252 and 254 could be integrally formed to cover all or much of the cover body 210. It is also contemplated that more panels 250 could be used. For example, the panel 254 could be replaced by multiple panels, such as a top panel and a separate rear panel.

The surface panels 250 are formed from acrylonitrile styrene acrylate (ASA). ASA material is a thermoplastic known for moldability and forming a glossy surface finish, resistance to scratching, relatively cost efficiency, and for forming a surface to which can be adhered decals. In the present embodiment, it can be provided in a thin layer as it does not need to provide structural rigidity. Other materials for the surface esthetic panels 250 are contemplated, including for example a thin layer of conventional fiberglass.

In addition to the structure provided by the cover body 210 and the esthetic surface structure 250, the cover 200 includes a noise dampening material layer 230 disposed on an exterior surface 212 of the cover body 210. The noise dampening material layer 230 is enclosed or encapsulated between the cover body 210 and the surface structure 250. Marine engine covers are often directly molded to form the exterior surface from the main body structure; in such structures, noise dampening material can only be added on an interior of the cover to not cover the outer esthetic surface. By the present technology, the noise dampening material layer 230 can be arranged on the exterior surface 212 of the cover body 210, as it is hidden and protected by the surface panels 250 to maintain an exterior esthetic surface.

The noise dampening material layer 230 is formed from noise vibration harshness (NVH) foam. In the present embodiment, the layer 230 is formed from several separated foam layer portions. The layer 230 includes left and right side foam portions 232 disposed on left and right sides of the cover body exterior 212. The layer 230 also includes a top side foam portion 234 disposed on a top side of the cover body exterior 212 and a rear side foam portion 236 disposed on a rear side of the cover body 210. It is contemplated that the foam portions 232, 234, 236 could cover more or less of the exterior 212 than in the illustrated embodiment. It is also contemplated that more or fewer foam portions could be included in different embodiments.

The cover 200 further includes an inner noise dampening material layer 280 disposed on an interior side 214 of the cover body 210. Similarly to the layer 230, the inner noise dampening material layer 280 is formed from NVH foam. Depending on the embodiment, the layers 230, 280 could be formed from the same or different materials. It is contemplated that one or both of the layers 230, 280 could be formed from fibrous materials (such as felt) or rubber materials, for example.

In the illustrated embodiment, the cover 200 further includes a plurality of bumpers 290 extending along an exterior of the cover 200. The bumpers 290 are formed from hard plastic, resistant to scratching; the exact material could vary. In the illustrated embodiment, the cover 200 includes two upper bumpers 292 disposed on the surface panel 254, the upper bumpers 292 extending along the top side of the cover 200 and onto a portion of the rear side of the cover 200. The cover 200 also includes two rear bumpers 294 disposed on the surface panel 254, extending from one end of a corresponding one of the upper bumpers 292 down to a rear, bottom edge of the cover 200.

The arrangement of the components of the cover 200 will now be described in more detail with reference to FIGS. 6 to 10. As is mentioned above, the noise dampening foam portions 230 are disposed between the cover body 210 and the surface structure 250. The foam portions 230 are fully enclosed by the surface panels 250. In the illustrated embodiment, the lateral side surface panels 252 overlap the front edge of the cover body 210 (FIG. 6), as well as lateral edges of the surface panel 254. In this way there are no gaps between the surface panels 252, 254. The front edge of the lateral side surface panels 252 are fastened to the cover body 210.

Figure 10:
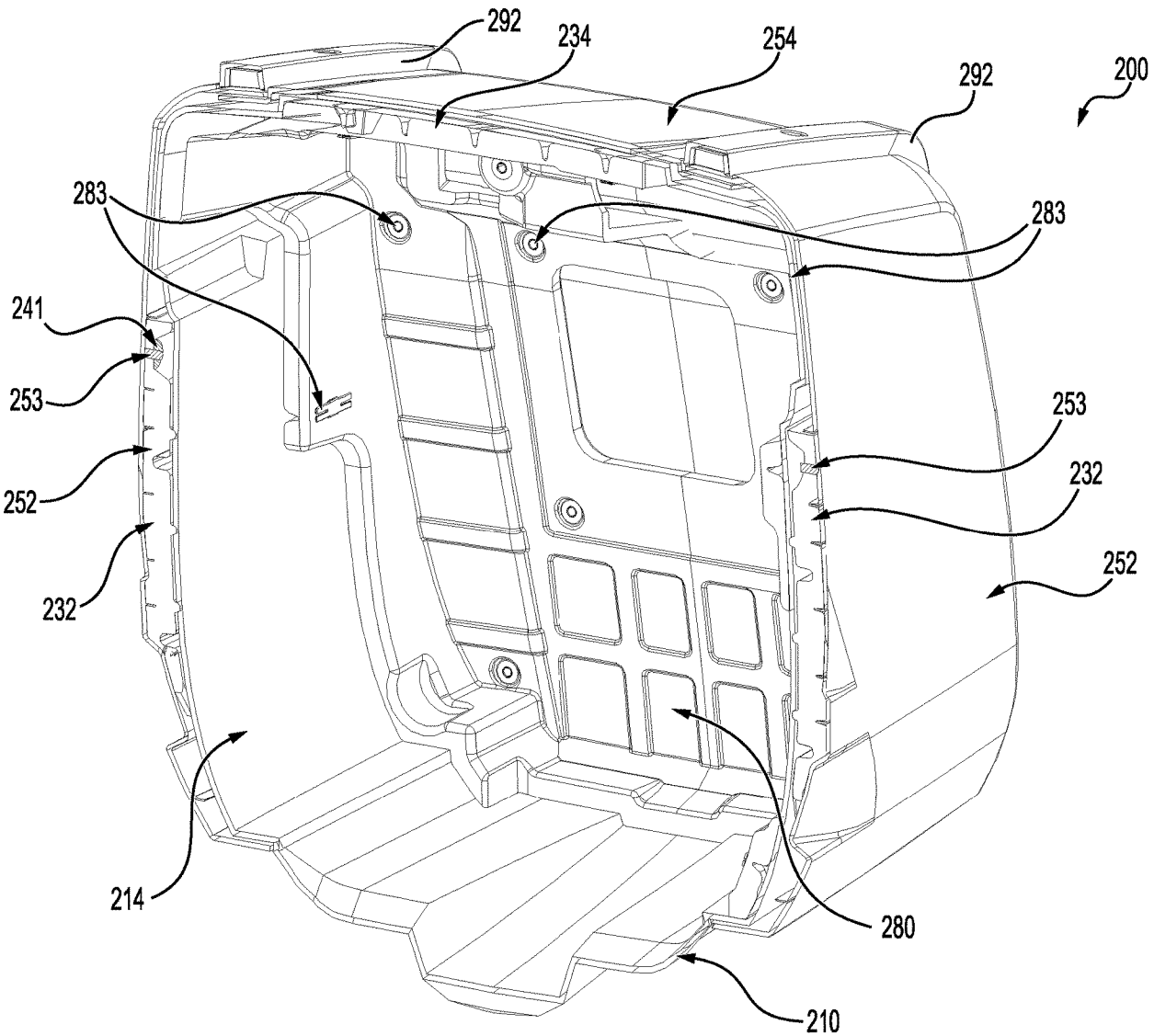
FIG. 10 is a cross-sectional, perspective view taken from a front, left side of the cover of FIG. 3.

The surface panels 252 include posts 253 for connecting the foam portions 232 to the surface panels 252 (FIG. 10, see also FIG. 5). The foam portions 232 are held on the posts 253 by washer clips 241 to maintain placement of the noise dampening layer 230 between the cover body 210 and the surface panels 252. The surface panel 254 similarly include posts (not shown) for connecting the foam portions 234, 236 to the surface panel 254. It is contemplated that different means could be used to maintain the placement of the noise dampening layer 230 relative to the cover body 210 and/or the surface structure 250.

Figure 7:
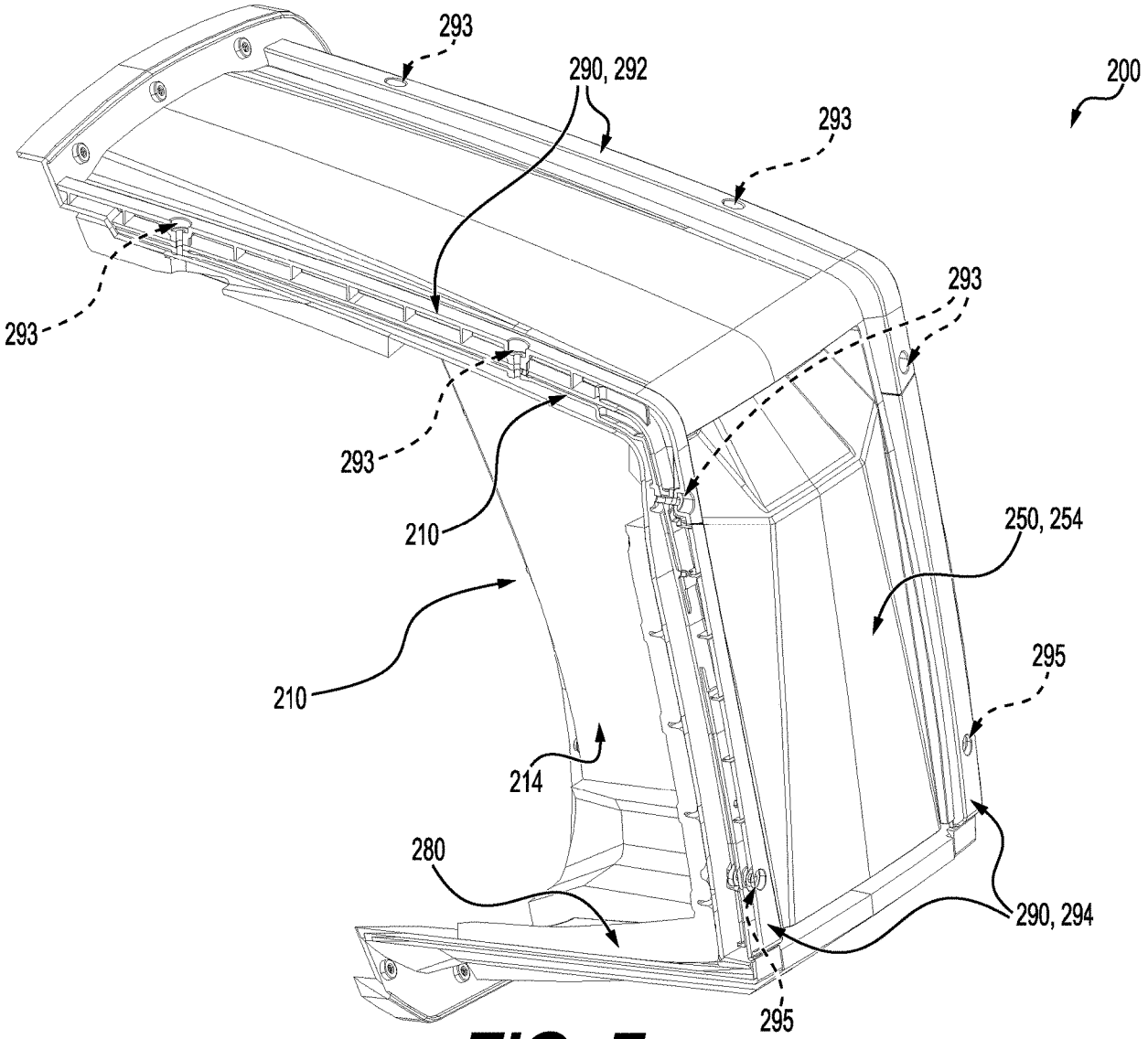
FIG. 7 is a cross-sectional, perspective view taken from the rear, left side of the cover of FIG. 3.
Figure 8:
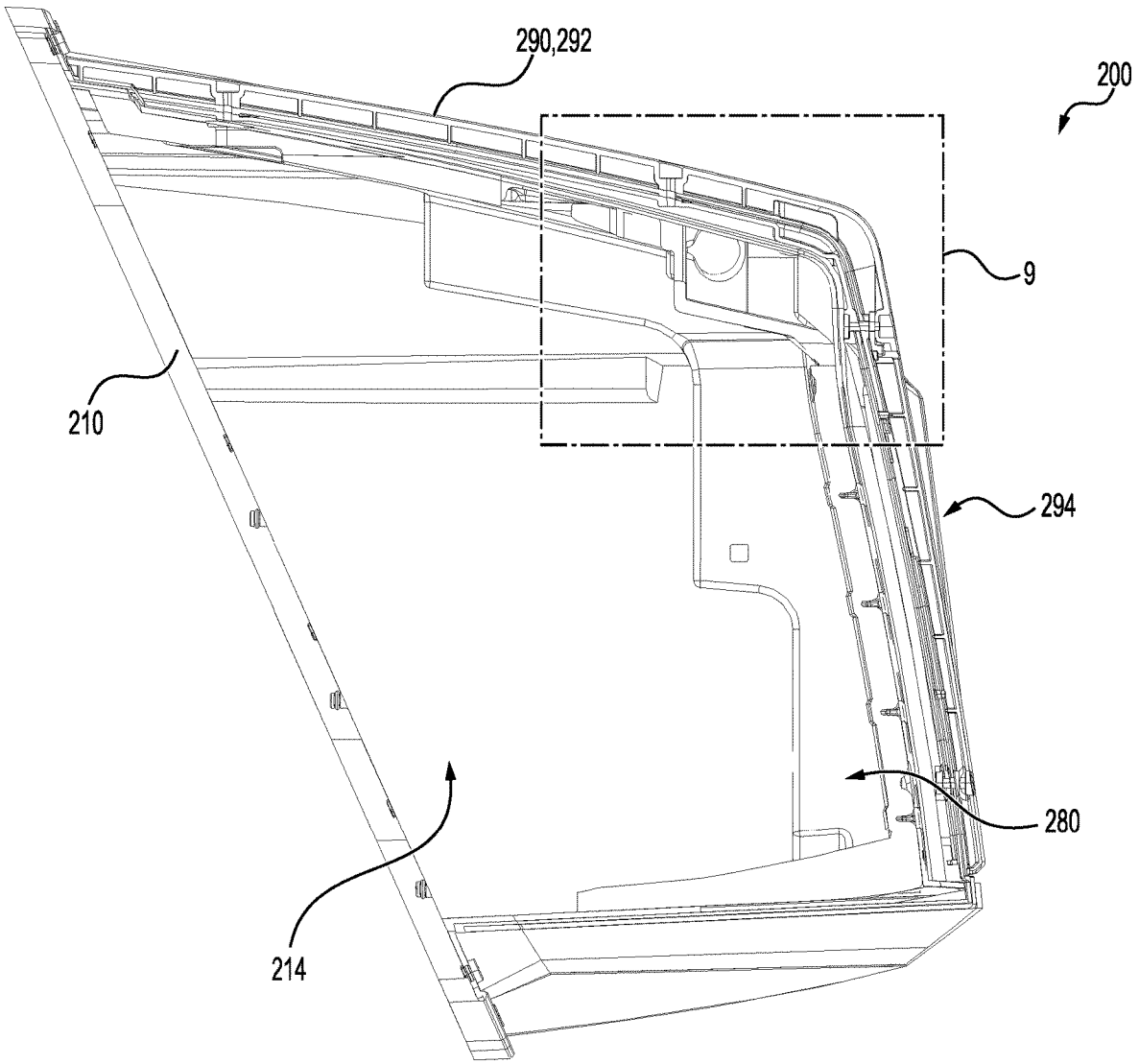
FIG. 8 is a left side elevation view of the cross-section of FIG. 7.
Figure 9:
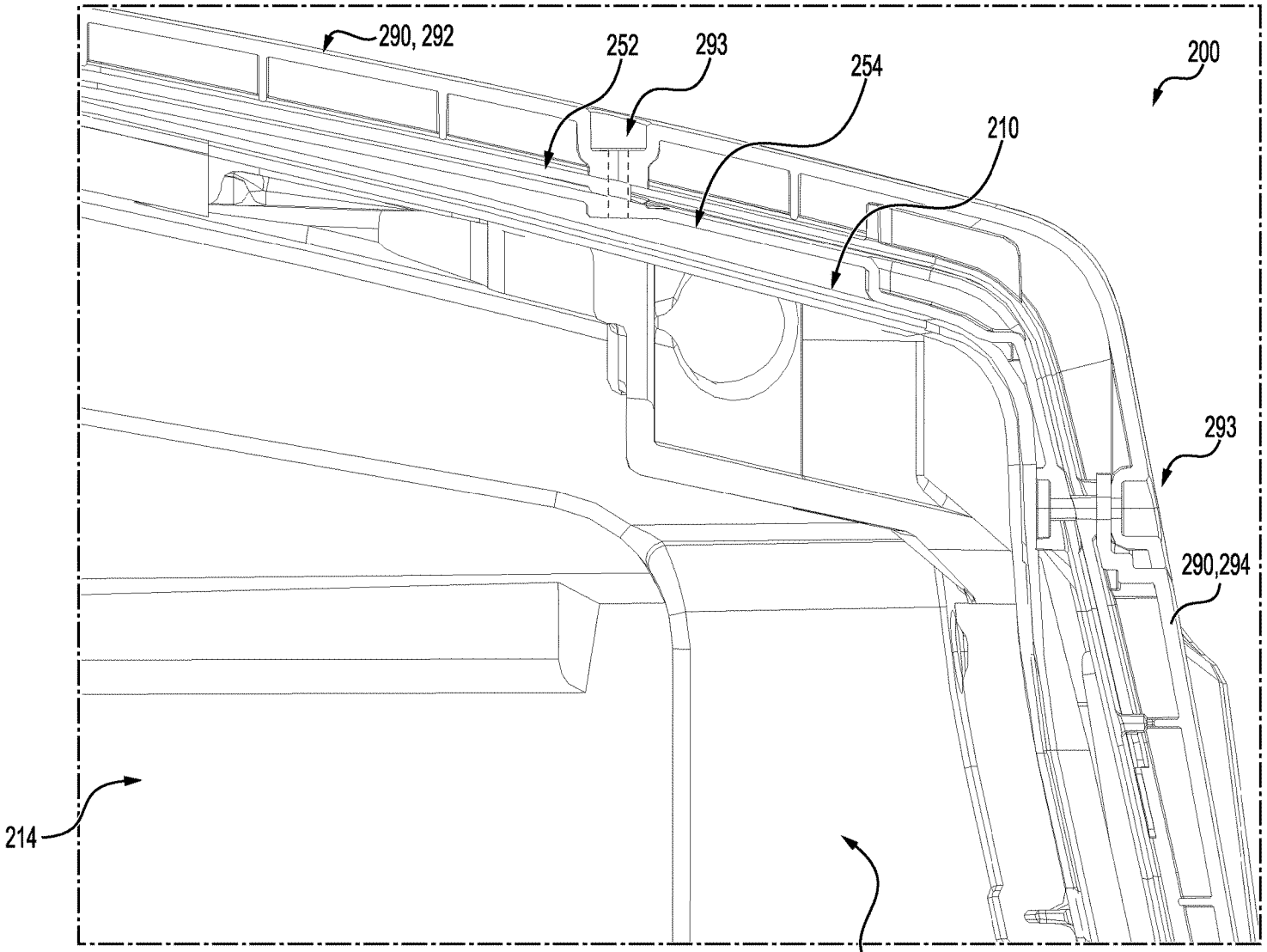
FIG. 9 is a close-up view of portion 9 of FIG. 8.

As can be seen in FIGS. 7 to 9, the upper bumpers 292 are fastened to the cover body 210 by a plurality of fasteners (not shown), specifically via through-holes 293 in the bumpers 292. The fasteners also extend through openings in lateral edges of the side surface panels 252 and the top, rear surface panel 254 to connect to the cover body 210. The top foam portion 234 is disposed laterally between the bumpers 292, such that the fasteners do not pass through the foam portion 234.

Similarly, the rear bumpers 294 are fastened to the cover body 210 by a plurality of fasteners (not shown), specifically through through-holes 295 in the bumpers 294. A top edge of each bumper 294 is received under a bottom edge of a corresponding bumper 292. The fasteners also extend through openings in rear edges of the side surface panels 252 and the top, rear surface panel 254 to connect to the cover body 210. The rear foam portion 236 is disposed laterally between the bumpers 292, such that the fasteners do not pass through the foam portion 234.

On the interior 214 of the cover body 210, the inner noise dampening material layer 280 is connected to the cover body 210 by clips 283. It is contemplated that different means could be used to maintain the placement of the inner noise dampening layer 280 relative to the cover body 210.

Modifications and improvements to the above-described embodiments of the present technology may become apparent to those skilled in the art. The foregoing description is intended to be exemplary rather than limiting.

What is claimed is:

1. A marine motor assembly for a watercraft, the marine motor assembly comprising:
- a housing;
- a motor disposed in the housing; and
- a propulsion device operatively connected to the motor,
- the housing comprising:
  - a housing portion, and
  - a cover selectively connected to the housing portion, the cover comprising:
    - a cover body connectable to the housing portion, the cover body covering at least a portion of the motor,
    - the housing portion and the cover body defining a volume enclosing the motor;
    - a noise dampening material layer disposed on an exterior side of the cover body and exterior to the volume; and
    - a surface structure connected to the cover body, the noise dampening material layer being enclosed between the cover body and the surface structure.

2. The marine motor assembly of claim 1, wherein:
- the cover body is formed from a first material;
- the surface structure is formed from a second material; and
- the first material and the second material are different materials.

3. The marine motor assembly of claim 2, wherein the first material has greater rigidity than the second material.

4. The marine motor assembly of claim 2, wherein the cover body provides structural integrity of the cover.

5. The marine motor assembly of claim 2, wherein the second material has a glossier surface finish.

6. The marine motor assembly of claim 1, wherein the cover body is sealingly connectable to the housing portion.

7. The marine motor assembly of claim 1, wherein the cover further comprises an inner noise dampening material layer disposed on an interior side of the cover body.

8. The marine motor assembly of claim 7, wherein the inner noise dampening material layer is formed from noise vibration harshness (NVH) foam.

9. The marine motor assembly of claim 7, wherein the inner noise dampening material layer is connected to the cover body by clips.

10. The marine motor assembly of claim 1, wherein the surface structure includes a plurality of surface panels.

11. The marine motor assembly of claim 10, wherein the plurality of surface panels comprises:
- at least one top side panel connected to a top side of the cover body; and
- at least one side panel connected to a lateral side of the cover body.

12. The marine motor assembly of claim 1, wherein the noise dampening material layer is formed from a plurality of separated layer portions.

13. The marine motor assembly of claim 1, wherein the noise dampening material layer is formed from noise vibration harshness (NVH) foam.

14. The marine motor assembly of claim 1, wherein the cover further comprises a plurality of bumpers extending along one of a top surface of the cover and a rear surface of the cover.

15. The marine motor assembly of claim 14, wherein each bumper of the plurality of bumpers is fastened to the cover body by a plurality of fasteners, the plurality of fasteners extending through the surface structure.

16. The marine motor assembly of claim 1, wherein:

the cover body is formed from direct long fiber thermoplastic (DLFT); and the surface structure is formed from acrylonitrile styrene acrylate (ASA).

17. The marine motor assembly of claim 16, wherein the DLFT forming the cover body is a glass fiber-reinforced polypropylene (thermoplastic) resin.

18. The marine motor assembly of claim 1, wherein the noise dampening material layer is encapsulated between the cover body and the surface structure.

19. The marine motor assembly of claim 1, wherein the noise dampening material layer contacts only an exterior surface of the cover body.

20. A cover for a marine motor assembly, the cover being connectable to a housing portion for forming a housing of the marine motor assembly, the cover comprising:

a cover body connectable to the housing portion, when the cover body is connected to the housing portion:

the cover body and the housing portion forming a volume to receive a motor therein, and the cover body covering at least a majority of power-pack components of the marine motor assembly;

a noise dampening material layer disposed on an exterior side of the cover body and exterior to the volume; and a surface structure connected to the cover body, the noise dampening material layer being enclosed between the cover body and the surface structure.

* * * * *